US011670167B2

(12) United States Patent
Naserian et al.

(10) Patent No.: US 11,670,167 B2
(45) Date of Patent: Jun. 6, 2023

(54) TRAFFIC LIGHT COUNTDOWN NOTIFICATION AND ALERT SUPPRESSION

(71) Applicant: GM GLOBAL TECHNOLOGY OPERATIONS LLC, Detroit, MI (US)

(72) Inventors: Mohammad Naserian, Windsor (CA); Feiyu Cong, Shanghai (CN); Jie Zhu, Shanghai (CN); Curtis L. Hay, Washington Township, MI (US); Priya B. Abraham, Sterling Heights, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/454,883

(22) Filed: Nov. 15, 2021

(65) Prior Publication Data

US 2023/0132658 A1 May 4, 2023

(30) Foreign Application Priority Data

Oct. 29, 2021 (CN) ..... 202111268752.2

(51) Int. Cl.
*G08G 1/0962* (2006.01)
*G08B 7/06* (2006.01)

(52) U.S. Cl.
CPC ..... *G08G 1/0962* (2013.01); *G08B 7/06* (2013.01)

(58) Field of Classification Search
CPC ..... G08G 1/0962; G08G 1/096; G08B 7/06; G08B 21/24
See application file for complete search history.

(56) References Cited

U.S. PATENT DOCUMENTS

| | | | | |
|---|---|---|---|---|
| 8,305,234 | B2 * | 11/2012 | Tauchi | G08G 1/091 340/576 |
| 10,730,457 | B1 | 8/2020 | Smith | |
| 2007/0027583 | A1 | 2/2007 | Tamir et al. | |
| 2017/0124868 | A1 * | 5/2017 | Bhat | G08G 1/09623 |
| 2020/0057487 | A1 * | 2/2020 | Sicconi | G06T 7/254 |
| 2021/0043083 | A1 * | 2/2021 | Bandi | G08G 1/096716 |
| 2021/0158963 | A1 | 5/2021 | Menon et al. | |

FOREIGN PATENT DOCUMENTS

| | | | |
|---|---|---|---|
| DE | 102015216502 | A1 | 3/2017 |
| WO | 2014053134 | A1 | 4/2014 |

* cited by examiner

*Primary Examiner* — Brian Wilson
(74) *Attorney, Agent, or Firm* — Lorenz & Kopf LLP

(57) ABSTRACT

A method for providing a driver alert including receiving a traffic signal phase state and a time remaining in the traffic signal phase state, determining a move forward time in response to the traffic signal phase state being red and the time remaining in the traffic signal phase state, displaying the move forward time to a driver, determining a driver attentiveness level, and generating a driver alert in response to the driver attentiveness level being below a threshold attentiveness level and the move forward time being less than a threshold time.

20 Claims, 5 Drawing Sheets

400

TRAFFIC LIGHT COUNTDOWN NOTIFICATION AND ALERT SUPPRESSION

CROSS REFERENCE TO RELATED APPLICATIONS

This application claims the benefit of Chinese Application No. 202111268752.2, filed Oct. 29, 2021 which is herein incorporated by reference in its entirety.

INTRODUCTION

The present disclosure relates generally to a system for providing traffic signal information to a driver within a motor vehicle. More specifically, aspects of the present disclosure relate to systems, methods and devices for determining a traffic signal state change time, providing a traffic signal countdown timer, for determining a driver attentiveness, and for providing an alert of an upcoming traffic signal state change to inattentive driver.

Communications systems, such as vehicle to everything (V2X) communications have enabled modern vehicles to communicate with data networks, proximate infrastructure, and other vehicles. These communications allow data to be exchanged, crowdsourced and analyzed to provide more information to these vehicles than was ever available before. For example, using signal phase and timing (SPaT) messaging enables traffic signal controllers to provide additional information to proximate vehicles, such as current light states for each lane of an intersection and time to state change for the lights. This information allows the vehicle to provide additional information and warnings to the driver about conditions that may not be readily apparent.

For example, a vehicle may provide an alert to a driver that a traffic light state has changed. Time to state change for the traffic light is not readily available to a driver without these communications systems, so an inattentive driver may be alerted when the vehicle is clear to move forward without holding up traffic at the intersection. However, if the driver is attentive to the driving operation, these constant alerts may become tedious and may be disabled by the driver, thereby rendering then nonoperative when they may be useful and beneficial to the driver. It would be desirable to provide a traffic light countdown notification system to a driver while overcoming the aforementioned problems.

The above information disclosed in this background section is only for enhancement of understanding of the background of the invention and therefore it may contain information that does not form the prior art that is already known in this country to a person of ordinary skill in the art.

SUMMARY

Disclosed herein are vehicle sensor methods and systems and related control logic for provisioning vehicle systems, methods for making and methods for operating such systems, and motor vehicles equipped with onboard control systems. By way of example, and not limitation, there are presented various embodiments of systems for the accurate determination of appropriate driver notification of traffic light state changes and a method for performing traffic light countdown notification and alert suppression in a motor vehicle herein.

In accordance with an aspect of the present disclosure, an apparatus including a receiver configured to receive a traffic signal phase state and a time remaining in the traffic signal phase state, a processor configured to determine a move forward time in response to the traffic signal phase state being red and the time remaining in the traffic signal phase state, for determining a driver attentiveness level, and for generating a control signal in response to the driver attentiveness level being below a threshold attentiveness level and the move forward time being less than a threshold time, a user interface for displaying the move forward time to a driver, and a driver alert system for generating a driver alert in response to the control signal.

In accordance with another aspect of the present disclosure wherein the driver alert system includes a haptic feedback to the driver.

In accordance with another aspect of the present disclosure wherein the driver alert system includes an acoustic feedback to the driver.

In accordance with another aspect of the present disclosure wherein the move forward time is further determined in response to a distance between a host vehicle and a stop line.

In accordance with another aspect of the present disclosure wherein the move forward time is further determined in response to at least one of a vehicle transmission state and a vehicle brake state.

In accordance with another aspect of the present disclosure wherein the user interface is a heads-up display.

In accordance with another aspect of the present disclosure wherein the user interface is operative to visually display the move forward time to the driver.

In accordance with another aspect of the present disclosure further including determining a host vehicle speed and wherein the move forward time is displayed in response to the host vehicle speed being below a threshold speed.

In accordance with another aspect of the present disclosure wherein the receiver is a SPaT receiver configured to receive a SPaT message and wherein the SPaT message is indicative of the traffic signal phase state and the time remaining in the traffic signal phase state.

In accordance with another aspect of the present disclosure, a method for providing a driver alert including receiving a traffic signal phase state and a time remaining in the traffic signal phase state, determining a move forward time in response to the traffic signal phase state being red and the time remaining in the traffic signal phase state, displaying the move forward time to a driver, determining a driver attentiveness level, and generating a driver alert in response to the driver attentiveness level being below a threshold attentiveness level and the move forward time being less than a threshold time.

In accordance with another aspect of the present disclosure wherein the driver alert includes a haptic feedback to the driver.

In accordance with another aspect of the present disclosure wherein the driver alert includes an acoustic feedback to the driver.

In accordance with another aspect of the present disclosure wherein the driver alert includes a visual feedback to the driver.

In accordance with another aspect of the present disclosure further including determining a distance between a host vehicle and a stop line and wherein the move forward time is determined in response to the distance between the host vehicle and the stop line.

In accordance with another aspect of the present disclosure wherein the traffic signal phase state and the time remaining in the traffic signal phase state are indicated by a SPaT message received via a vehicle to infrastructure wireless transmission.

In accordance with another aspect of the present disclosure wherein the move forward time is further determined in response to at least one of a vehicle transmission state and a vehicle brake state.

In accordance with another aspect of the present disclosure wherein the move forward time is displayed to the driver on a heads-up display.

In accordance with another aspect of the present disclosure wherein the driver attentiveness level is determined in response to a driver's vision being directed to at least one of a traffic signal and a display indicative of the move forward time.

In accordance with another aspect of the present disclosure, a vehicular control system including a SPaT receiver for receiving an SPaT message wherein the SPaT message includes a traffic signal phase state and a time remaining in the traffic signal phase state, a display for displaying a move forward time, a global navigation satellite system for determining a host vehicle location, a memory configured to store a map data wherein the map data includes a location of a stop line, a driver monitoring system to determine a driver attentiveness level, a driver alert system for generating at least one of a haptic alert, an audible alert, and a visual alert, and a processor configured to determine a distance between the host vehicle and the stop line, the move forward time in response to a distance between the host vehicle and the stop line, the traffic signal phase state and the time remaining in the traffic signal phase state, the processor being further configured to generate a control signal in response to the driver attentiveness level being below a threshold attentiveness level and the move forward time being below a threshold time.

In accordance with another aspect of the present disclosure wherein the threshold time is determined in response to the distance between the host vehicle and the stop line, the driver attentiveness level, and a vehicle transmission state.

The above advantage and other advantages and features of the present disclosure will be apparent from the following detailed description of the preferred embodiments when taken in connection with the accompanying drawings.

BRIEF DESCRIPTION OF THE DRAWINGS

The exemplary embodiments will hereinafter be described in conjunction with the following drawing figures, wherein like numerals denote like elements, and wherein.

The exemplifications set out herein illustrate preferred embodiments of the invention, and such exemplifications are not to be construed as limiting the scope of the invention in any manner.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Figure 1:
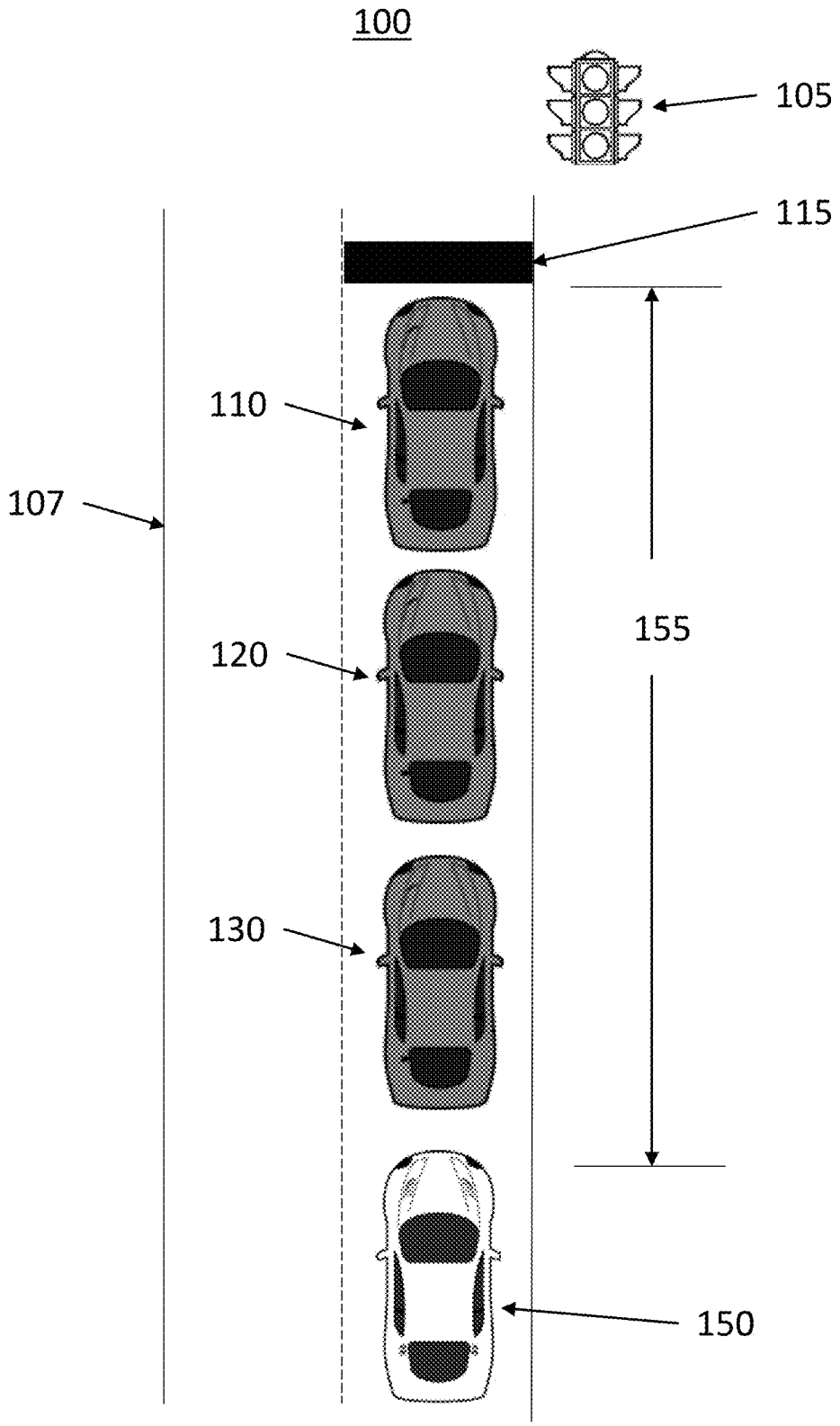
FIG. 1 shows an exemplary environment for use of the traffic light countdown notification and alert suppression system according to an exemplary embodiment of the present disclosure.

Turning now to FIG. 1, an exemplary environment 100 for use of the traffic light countdown notification and alert suppression system according to an exemplary embodiment of the present disclosure; is shown. The exemplary environment 100 depicts a road surface 107 leading to traffic light 105 having a stop line 115, and a first vehicle 110, a second vehicle 120, a third vehicle 130 and a host vehicle 150.

In this exemplary embodiment, the first vehicle 110, the second vehicle 120, the third vehicle 130 and the host vehicle 150 are depicted as waiting for a change of state of the traffic light 105. A distance 155 from the host vehicle to the stop line is also shown. Systems within the host vehicle 150 are configured to determine a distance 155 between the stop line 115 and the host vehicle 150. The distance 155 may be determined by using map data to determine the location of the stop line 115 and global positioning system (GPS) data or the like, for determining the location of the host vehicle 150. Alternatively, the host vehicle 150 may determine the number of vehicles between the stop line 115 and the host vehicle 150 and estimate the distance 155 in response to an average vehicle length for each of the vehicles. The number of vehicles between the stop line 115 and the host vehicle 150 may be determined in response to vehicle to vehicle (V2V) communications, processing of image data or other sensor data, such as a lidar depth map.

Once the distance 155 is determined, systems within the host vehicle 150 estimates a move forward time at which the host vehicle may move forward. The move forward time may be the time at which the host vehicle may be expected to be able to move forward. For example, if the host vehicle is the first vehicle in line at a traffic light, the move forward time will be the time at which the traffic light changes from red to green for the host vehicle lane. If the host vehicle is the third vehicle in line and it is estimated that it takes 1.5 seconds for each of the vehicles in front to begin to move after the prior vehicle moves, the estimated move forward time for the host vehicle would be the time at which the traffic light changes from red to green for the host vehicle lane plus 3 seconds.

The move forward time may be estimated in response to a time remaining in a red light cycle, the number of vehicles between the host vehicle 150 and the stop line 115 as well as if the host vehicle 150 or host vehicle transmission has been placed in park and if the host vehicle brake is applied. Once the move forward time is estimated, systems within the host vehicle 150 may present a countdown timer showing the time remaining until the move forward time. The move forward time may be displayed using a countdown timer displaying the time remaining until the move forward event.

The move forward time may be presented as a heads-up display (HUD) on a vehicle display, or other driver interface.

Once the countdown timer reaches a threshold remaining time, systems within the host vehicle 150 may provide a visual or acoustic alert, such as a chime, or a haptic alert, such as seat vibration, to notify the driver of the upcoming move forward time. However, the system may determine if the driver is attentive to the driving operation and suppress the alert. Driver attentiveness may be determined using interior cameras and other driving monitoring systems. It may be desirable to suppress the alert such that the driver is not receiving excessive alerts while driving and being attentive to the driving operations.

Figure 2:
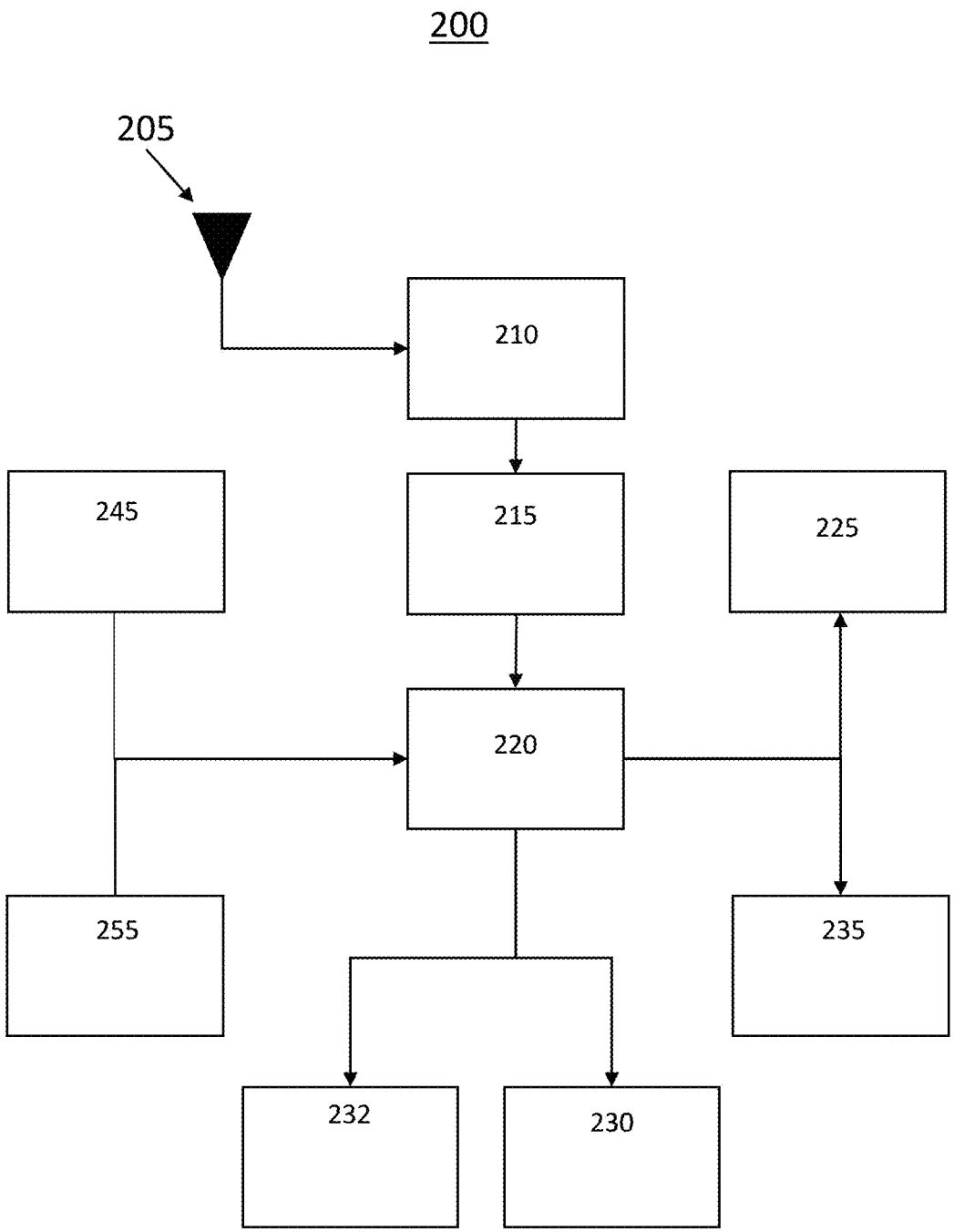
FIG. 2 shows a block diagram illustrating a system for implementing the traffic light countdown notification and alert suppression system in a motor vehicle according to an exemplary embodiment of the present disclosure.

Turning now to FIG. 2, a block diagram illustrating a system 200 for implementing the traffic light countdown notification and alert suppression system in a motor vehicle according to an exemplary embodiment of the present disclosure is shown. The exemplary system 200 may include an antenna 205, a Signal Phase and Timing (SPaT) receiver 210, a telemetrics module 215, a processor 220, a driver information center 230, an augmented reality (AR) heads up device (HUD) 225, a driver alert system 235, an object detection system 345, and a driver monitoring system 255.

The SPaT receiver 210 may be configured to receive SPaT messages from a vehicle to infrastructure (V2I) transmitter via the antenna 205. The SPaT message may define the current intersection signal light phases and current state of all lanes at the intersection. The data received via the SPaT message may then be coupled to the telemetrics module 215 for processing and coupling to the processor 220. The telemetrics module 215 is configured to provide wireless connectivity between the host vehicle, other vehicles, infrastructure and data networks. The telemetrics module may include a plurality of antennas, modulators, demodulators, signal processors, and the like to process, transmit, and receive radio frequency signals carrying data for use by the vehicle, such as system updates, updated map data, infotainment system data and the like. The telemetrics module 215 may further include a GPS receiver for receiving GPS satellite signals used for determining a host vehicle location.

The processor 220 is configured to receive the SPaT message data and the host vehicle location data and to determine a traffic light state for a current vehicle lane. In response to the SPaT message, the processor 220 is configured to determine a distance from the host vehicle to the stop line of the current vehicle lane. The distance may be determined in response to the GPS data and map data indicative of the stop line location. Alternatively, the distance may be estimated by determining a number of vehicles between the host vehicle and the stop line.

The processor 220 next determines from the SPaT message data if the signal state of the traffic light is red for the current vehicle lane. If the signal state is red, the processor next determines the vehicle speed. The vehicle speed may be determined in response to data from a vehicle controller 232, such as data from a wheel speed sensor, vehicle transmission sensor or the like. Alternatively, the vehicle speed may be determined in response to periodic location determinations in response to GPS data. If the speed of the vehicle is less than a threshold speed and the distance to the stop line is less than a threshold distance, the processor 220 may estimate that the vehicle is stopped or stopping in response to the red signal state of the traffic light. The processor 220 then determines the time to the next state change of the traffic light from the SPaT message data.

The processor 220 may estimate the move forward time for the host vehicle in response to the time to the next state of change of the traffic light and the number of vehicles between the host vehicle and the stop line. The number of vehicles between the host vehicle and the stop line may be estimated using the object detection system 345. Alternatively, the number of vehicles may be estimated using a host vehicle location determined from GPS data and map data indicative of the location of the stop line. The processor 220 may also adjust the move forward time in response to host vehicle conditions which may result in additional time being required for the host vehicle to move forward, such as the host vehicle being shifted to park, the engine being shut off, and/or the driver's foot not depressing the brake pedal.

The estimated time to the next state change of the traffic light and/or the estimated move forward time may be coupled from the processor 220 to the driver information center 230 for display to the driver. In addition or alternatively, the move forward time may be displayed to the driver on an augmented reality (AR) heads up device (HUD) 225. While the move forward time is being displayed, the driver monitoring system 255 may be determining if the driver is attentive to the displayed move forward time or is attentive to the traffic light. For example, if the driver's vision is directed to a location other than an attentive driving position, such as towards the passenger seat, or downwards towards an object in the driver's hands, the driver monitoring system 255 may determine that the driver's attention is not directed towards the driving operations.

In the case where the driver's attention may not be directed towards the driving operation, the driver monitoring system 255 may transmit data indicative of driver non-engagement to the processor 220. The processor 220 may then couple a control signal to the driver alert system 235 to generate an audible and/or haptic alert to alert the driver of the upcoming move forward event. For example, if the driver is determined to be not engaged, an audible and/or haptic alert may be provided two seconds before the move forward time expires. This provides some warning to the driver to reengage and prepare to drive the vehicle. In the case where the driver is determined to be attentive, the driver alert may not be required. If the driver monitoring system 255 determines the driver is attentive and engaged in the driving operation by either looking towards the traffic signal or looking towards the driver information center 230 displaying the move forward time, the driver monitoring system 255 transmits data indicative of the driver attentiveness to the processor 220. The processor 220 in turn does not transmit a control signal to the driver alert system 235 or suppresses the alert to be provided to the driver as the move forward time reaches the alert threshold.

Figure 3:
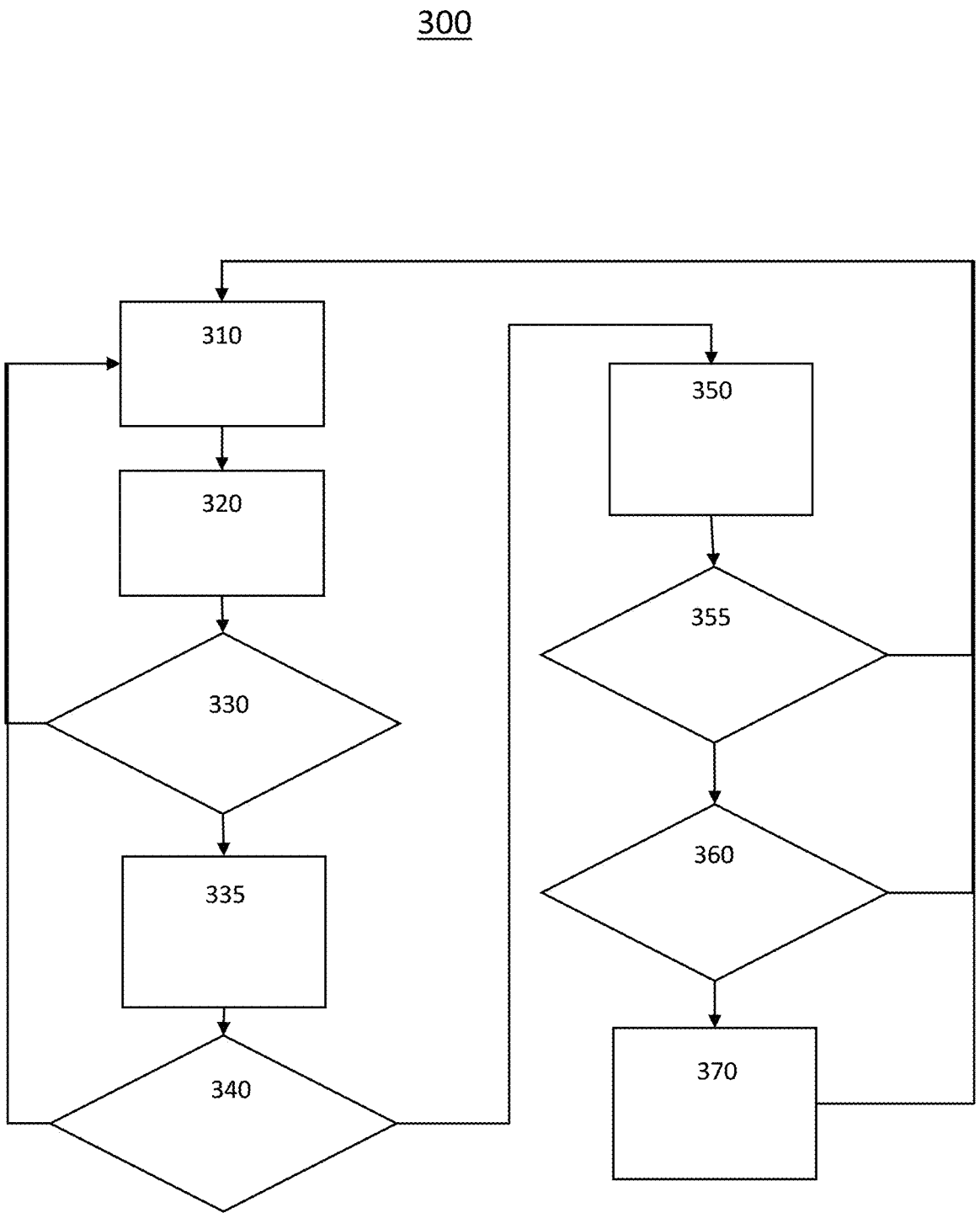
FIG. 3 shows a flow chart illustrating an exemplary method for performing the traffic light countdown notification and alert suppression system according to an exemplary embodiment of the present disclosure.

Turning now to FIG. 3, a flow chart illustrating an exemplary method 300 for traffic light countdown notification and alert suppression in a motor vehicle according to an exemplary embodiment of the present disclosure is shown. Some exemplary methods are first configured to receive 310 a SPaT message related to a proximate traffic signal operation. The SPaT message may be received via vehicle to infrastructure (V2I) communications or other wireless communications network. The SPaT message may be transmitted periodically, such as every 100 ms. The SPaT message may be indicative of the current phase of the traffic signal for every traffic lane of an intersection. The SPaT message also provides a time remaining of the phase for every lane.

The method is next configured to calculate 320 a distance between the host vehicle and a stop line in the host vehicle lane at the intersection. The distance may be estimated in response to a location of the traffic signal according to map data stored in a memory of the host vehicle or in response to one or more images captured by a camera or optical sensor of the host vehicle. The distance may be estimated by determining a number of vehicles between the host vehicle and the stop line and summing an estimated length for each vehicle.

The method next determines 330 if the traffic signal state is red for the host vehicle lane. The traffic signal state may be determined in response to the SPaT message and/or in response to one or more images captured by a host vehicle camera. If the traffic state signal is determined not to be red, the method returns to wait to receive 310 a subsequent SPaT message. If the traffic signal state is red, the method is next operative to estimate 335 the move forward time for the host vehicle in response to the distance between the host vehicle and the stop line and the time remaining in the red traffic light phase for the current traffic light phase. The move forward operation may be the time at which the host vehicle can begin moving forward towards the intersection or the like. In some exemplary embodiments, the move forward time may be set to the time remaining in the red traffic light phase for the current traffic light phase.

The method next determines 340 if the distance to the stop line is less than a threshold value and if the speed of the vehicle is less than a threshold value. If the speed and/or distance to the stop line is greater than the threshold value, the method returns to wait to receive 310 a subsequent SPaT message. If the speed and distance to the stop line are less than the threshold value, the method displays 350 the at least one of the time remaining until the next traffic signal state change and the move forward time for the host vehicle.

The method next determines 355 if a move forward time or the time remaining until the next traffic signal state change is less than a threshold time. The threshold time may be an amount of time remaining to alert the driver that the move forward operation is upcoming. For example, the threshold time may be two seconds such that the driver may be alerted to the upcoming move forward operation two seconds before the move forward operation is estimated to occur. If the move forward time is greater than the threshold time, the method returns to wait to receive 310 a subsequent SPaT message.

If the move forward time is less than the threshold time, the method next determines 360 if the driver is attentive to the driving operation. The driver attentiveness may be estimated by a driver monitoring system or the like. Driver attentiveness may be estimated by determining the direction of a driver's vision determined my monitoring eye and or head position, position of the driver in the driver's seat, steering wheel monitoring, etc. If the driver's estimated attentiveness is below the threshold, the method is then operative to issue 370 a driver alert. The driver alert may be an audible chime and/or a haptic feedback such as a seat vibration or the like. The method then returns to wait to receive 310 a subsequent SPaT message. If the driver is determined to be attentive, or the driver's attentiveness level exceeds a minimum threshold, the driver alert is suppressed or not generated and the method returns to wait to receive 310 a subsequent SPaT message.

Figure 4:
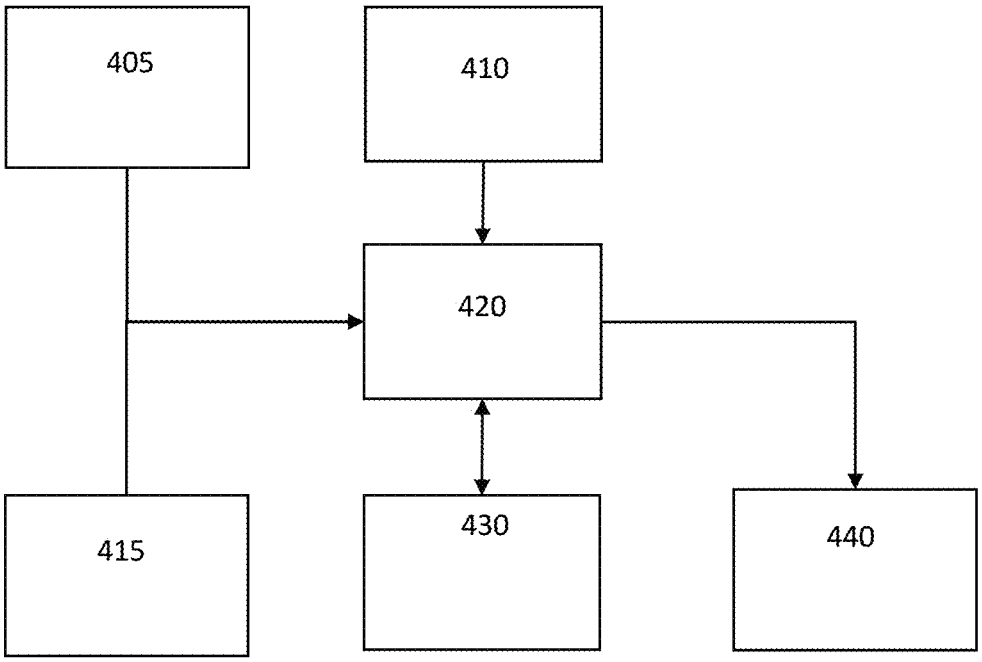
FIG. 4 shows another block diagram illustrating a system for implementing the traffic light countdown notification and alert suppression system in a motor vehicle according to an exemplary embodiment of the present disclosure.

Turning now to FIG. 4, a block diagram of a system 400 for traffic light countdown notification and alert suppression in a motor vehicle according to an exemplary embodiment of the present disclosure is shown. The system may include a GPS 405, a receiver 410, a memory 415, a processor 420, a user interface 430 and a driver alert system 440.

The receiver 410 may be configured to receive a traffic signal phase state and a time remaining in the traffic signal phase state. In some exemplary embodiments, the receiver may be a SPaT receiver configured to receive a SPaT message. The SPaT message may be indicative of the traffic signal phase state and the time remaining in the traffic signal phase state. The SPaT message may be transmitted from the traffic signal controller to the receiver via a V2I wireless communications channel.

The processor 420 may be configured to determine a move forward time in response to the traffic signal phase state being red and the time remaining in the traffic signal phase state. The move forward time is the time remaining until it is expected that the host vehicle will be free to start moving towards the intersection. The move forward time may be increased in response to a distance between a host vehicle and a stop line. For example, the more cars that are between the host vehicle and the stop line, the longer it will take until the host vehicle can start moving forward as each vehicle will create a short time delay before they start moving. The move forward time would be the same as the time remaining in the traffic signal state if the host vehicle was first in line at the stop line. The move forward time may also be adjusted in response to at least one of a vehicle engine being shut off, a vehicle transmission state being in park and a vehicle brake state being applied or not applied and a park brake being applied or not applied. Each of these conditions will require time for a driver to put the vehicle in a ready to drive condition, so the move forward time may be adjusted in light of these conditions.

The processor 420 may be further operative to estimate a driver attentiveness level and to generate a control signal in response to the driver attentiveness level being below a threshold attentiveness level and the move forward time being less than a threshold time. The processor 420 may receive image data from a vehicle camera, steering controller, and/or other driver monitoring sensor and determine a duration of time since the driver has been engaged in the driving operation. For example, if the driver is looking forward in the direction of the traffic signal or towards the move forward time display, it may be determined that the driver attentiveness level is high. If the driver has been looking away from the front of the vehicle for greater than 30 seconds, it may be determined that the driver attentiveness level is lower. In some embodiments, the longer the duration of time that the driver has not looked towards the traffic signal, the lower the driver attentiveness level. The processor 420 may further determine a host vehicle speed. In some embodiments, the processor 420 may couple the move forward time to the display in response the to the host vehicle speed being below a threshold speed.

The user interface 430 may be configured for displaying the move forward time to a driver. In some embodiments, the user interface may be a heads-up display. The user interface 430 may be operative to visually display the move forward time to the driver on a vehicle display device, such as an instrument panel.

The exemplary system 400 may further include a driver alert system 440 for generating a driver alert in response to the control signal. In some embodiments, the driver alert system 440 may include devices to provide at least one of a haptic feedback to the driver, an acoustic feedback to the driver, and a visual feedback to the driver.

In some exemplary embodiments, the exemplary system 400 may be a vehicular control system. The receiver 410 may be a SPaT receiver for receiving a SPaT message. The SPaT message may include data related to the operation of the traffic signal, such as traffic signal phase state for each lane of the intersection, time remaining in the traffic signal phase state, and the like.

The user interface 430 may include a display, such as an LED display, indicator lights, and/or analog gauges to display a move forward time from the processor 420. The processor 420 may be configured to determine a distance between the host vehicle and the stop line, the move forward time in response to a distance between the host vehicle and the stop line, the traffic signal phase state and the time remaining in the traffic signal phase state. The processor 420 may be further configured to generate a control signal in response to the driver attentiveness level being below a threshold attentiveness level and the move forward time being below a threshold time. The threshold time may be determined in response to the distance between the host vehicle and the stop line, the driver attentiveness level, and a vehicle transmission state.

To determine the distance between the host vehicle and the stop line, a global navigation satellite system 405 may be used for determining a host vehicle location. A memory 415 may be coupled to the processor 420 and be configured to store a map data wherein the map data includes a location of a stop line. The processor 420 may then calculate the distance between the stop line and the host vehicle location.

The driver alert 440 may include at least one driver interface, for generating at least one of a haptic alert, an audible alert, and a visual alert. The driver alert 440 may be generated in response to the control signal generated by the processor 420.

Figure 5:
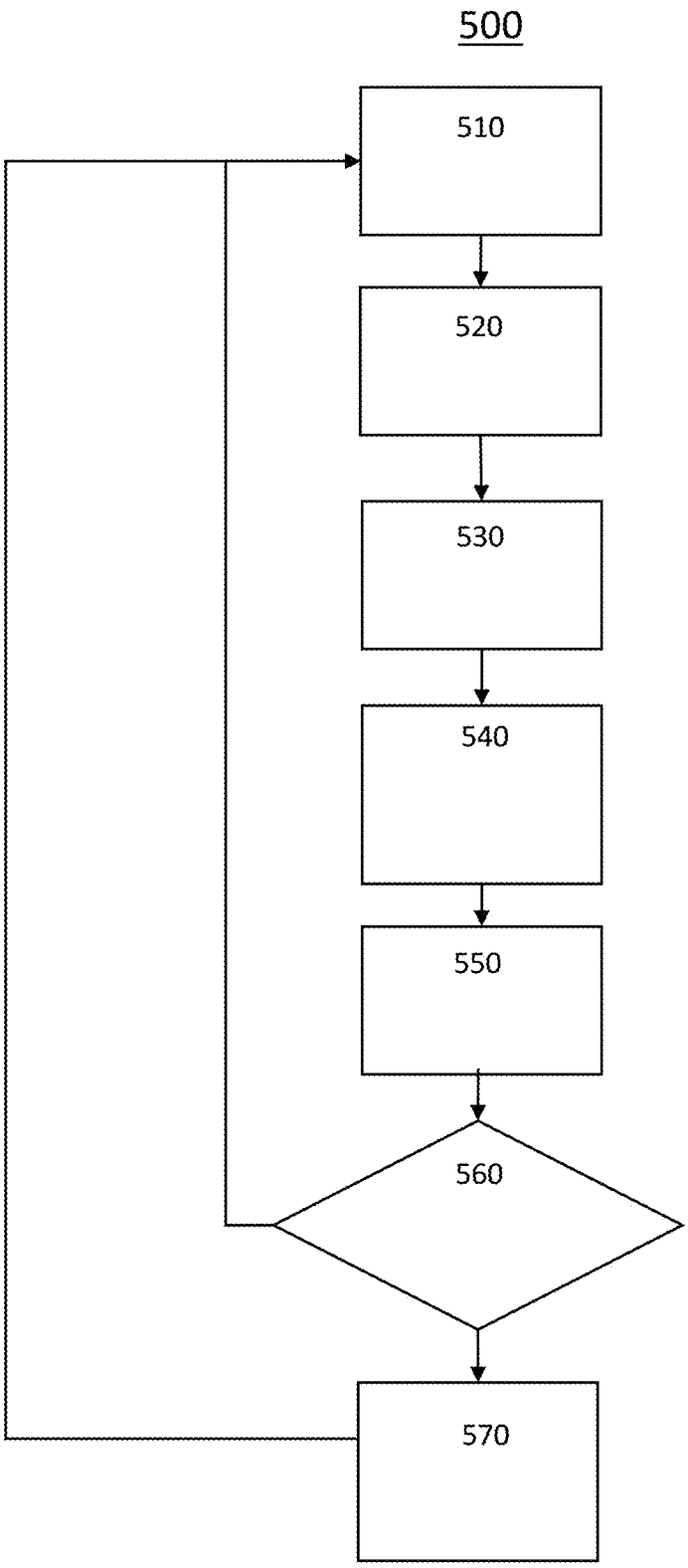
FIG. 5 shows another flow chart illustrating an exemplary method for performing the traffic light countdown notification and alert suppression system according to an exemplary embodiment of the present disclosure.

Turning now to FIG. 5, a flow chart illustrating another exemplary method 500 for implementing a traffic light countdown notification and alert suppression system in a motor vehicle according to an exemplary embodiment of the present disclosure is shown. The method is first operative for receiving 510 a traffic signal phase state and a time remaining in the traffic signal phase state. In some embodiments, the traffic signal phase state and the time remaining in the traffic signal phase state may be indicated by a SPaT message received via a V2I wireless transmission.

The method is next operative for determining 520 a distance between a host vehicle and a stop line. The stop line may be a stop line within the host vehicle lane. The stop line may be proximate to the traffic signal and an intersection of roadways where the traffic signal is located. The stop line location may be determined in response to map data stored in a memory in the host vehicle. Alternatively, the stop line location may be estimated in response to the host vehicle location and an image captured of the stop line captured by a host vehicle camera. The host vehicle location may be determined in response to a global navigation satellite system (GNSS) or the like.

A move forward time is next determined 530 in response to the traffic signal phase state being red and the time remaining in the traffic signal phase state. In addition, the move forward time may be determined in response to the distance between the host vehicle and the stop line. In some embodiments, the move forward time is further determined in response to at least one of a vehicle transmission state and a vehicle brake state. For example, if the vehicle transmission is in a park state, time may be subtracted from the move forward time to allow time for a driver to shift the transmission from park to drive.

The method is next operative for displaying 540 the move forward time to a driver. The move forward time may be displayed on a vehicle display, such as a center stack display, an instrument cluster display or the like. The move forward time may also be displayed to the driver on a heads-up display.

The method next determines 550 a driver attentiveness level. The driver attentiveness level may be determined in response to a driver's vision being directed at the traffic signal and an amount of time elapsed since the driver's vision was directed to the traffic signal. The driver attentiveness level may be determined in response to a driver's vision being directed at the display indicative of the move forward time and an amount of time elapsed since the driver's vision was directed to the display.

If the driver attentiveness level is determined to be less than a threshold level and the move forward time being less than a threshold time, the method is configured for generating 570 a driver alert. A driver attentiveness level being less than a threshold level may be indicative of a driver being distracted by something other than the vehicle operations. For example, the driver's attention may be directed to a mobile phone or the like. In some embodiments, the driver alert may include at least one of a haptic feedback to the driver, an acoustic feedback to the driver, such as a chime or buzzer, and a visual feedback to the driver, such as an illuminated light emitting diode or message displayed on a vehicle display. If the driver attentiveness level is higher than the threshold level or the move forward time is greater than the threshold time, the driver alert is suppressed and/or not generated and the method returns to receiving 510 a subsequent SPaT message.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. An apparatus comprising:

a receiver configured to receive a traffic signal phase state and a time remaining in the traffic signal phase state;

a processor configured to determine a move forward time in response to the traffic signal phase state being red, a distance between a host vehicle and a stop line, and the time remaining in the traffic signal phase state, for determining a driver attentiveness level, and for generating a control signal in response to the driver attentiveness level being below a threshold attentiveness level and the move forward time being less than a threshold time, wherein the control signal is generated at a time determined in response to the driver attentiveness level and the move forward time;

a user interface for displaying the move forward time to a driver; and a driver alert system for generating a driver alert in response to the control signal.

2. The apparatus of claim 1, wherein the driver alert system includes a haptic feedback to the driver.

3. The apparatus of claim 1, wherein the driver alert system includes an acoustic feedback to the driver.

4. The apparatus of claim 1, wherein the threshold time is determined in response to the distance between the host vehicle and the stop line, the driver attentiveness level, and a vehicle transmission state.

5. The apparatus of claim 1, wherein the move forward time is further determined in response to a vehicle transmission.

6. The apparatus of claim 1 wherein the user interface is a heads-up display.

7. The apparatus of claim 1 wherein the user interface is operative to visually display the move forward time to the driver.

8. The apparatus of claim 1 further including determining a host vehicle speed and wherein the move forward time is displayed in response to the host vehicle speed being below a threshold speed.

9. The apparatus of claim 1 wherein the receiver is a SPaT receiver configured to receive a SPaT message and wherein the SPaT message is indicative of the traffic signal phase state and the time remaining in the traffic signal phase state.

10. A method comprising:

receiving a traffic signal phase state and a time remaining in the traffic signal phase state;

determining a move forward time in response to the traffic signal phase state being red, a distance between a host vehicle and a stop line, and the time remaining in the traffic signal phase state;

displaying the move forward time to a driver;

determining a driver attentiveness level; and generating a driver alert in response to the driver attentiveness level being below a threshold attentiveness level and the move forward time being less than a threshold time, wherein the driver alert is generated at a time determined in response to the driver attentiveness level and the move forward time.

11. The method of claim 10, wherein the driver alert includes a haptic feedback to the driver.

12. The method of claim 10, wherein the driver alert includes an acoustic feedback to the driver.

13. The method of claim 10, wherein the driver alert includes a visual feedback to the driver.

14. The method of claim 10, wherein the threshold time is determined in response to the distance between the host vehicle and the stop line, the driver attentiveness level, and a vehicle transmission state.

15. The method of claim 10, wherein the traffic signal phase state and the time remaining in the traffic signal phase state are indicated by a SPaT message received via a vehicle to infrastructure wireless transmission.

16. The method of claim 10, wherein the move forward time is further determined in response to a vehicle transmission state.

17. The method of claim 10, wherein the move forward time is displayed to the driver on a heads up display.

18. The method of claim 10 wherein the driver attentiveness level is determined in response to a driver's vision being directed to at least one of a traffic signal and a display indicative of the move forward time.

19. A vehicle control system comprising:

a SPaT receiver for receiving a SPaT message wherein the SPaT message includes a traffic signal phase state and a time remaining in the traffic signal phase state;

a display for displaying a move forward time;

a global navigation satellite system for determining a host vehicle location of a host vehicle;

a memory configured to store a map data wherein the map data includes a location of a stop line;

a driver monitoring system to determine a driver attentiveness level;

a driver alert system for generating at least one of a haptic alert, an audible alert, and a visual alert; and a processor configured to determine a distance between the host vehicle and the stop line, the move forward time in response to the distance between the host vehicle and the stop line, the traffic signal phase state and the time remaining in the traffic signal phase state, the processor being further configured to generate a control signal in response to the driver attentiveness level being below a threshold attentiveness level and the move forward time being below a threshold time, wherein the control signal is generated at a time determined in response to the driver attentiveness level and the move forward time.

20. The vehicle control system of claim 19 wherein the threshold time is determined in response to the distance between the host vehicle and the stop line, the driver attentiveness level, and a vehicle transmission state.

* * * * *